US005331379A

United States Patent [19]

Yoneda et al.

[11] Patent Number: 5,331,379

[45] Date of Patent: Jul. 19, 1994

[54] IMAGE FORMING APPARATUS CAPABLE OF CHANGING THE SURFACE POTENTIAL OF A PHOTOSENSITIVE MEMBER

[75] Inventors: Shinsaku Yoneda, Kashihara; Yoshiyuki Ishizuka, Hirakata; Naoki Motobayashi, Tondabayashi; Takehiko Okada, Sakai, all of Japan

[73] Assignee: Mita Industrial Co., Ltd., Osaka, Japan

[21] Appl. No.: 985,419

[22] Filed: Dec. 4, 1992

[30] Foreign Application Priority Data

Dec. 18, 1991 [JP] Japan ..... 3-335089

[51] Int. Cl.[5] ..... G03G 15/02

[52] U.S. Cl. ..... 355/214; 355/225; 361/229; 361/235

[58] Field of Search ..... 355/214, 219, 221, 222, 355/225; 361/235, 229, 230

[56] References Cited

U.S. PATENT DOCUMENTS 3,724,941 4/1973 Honjo et al. ..... 355/214
5,087,944 2/1992 Yamauchi ..... 355/225

*Primary Examiner*—Joan H. Pendegrass

*Attorney, Agent, or Firm*—Jordan and Hamburg

[57] ABSTRACT

An image forming apparatus is provided with a photosensitive member; a charger including a corona ion generator and a grid electrode provided between the photosensitive member and the corona ion generator, and adapted for charging the surface of the photosensitive member while regulating the surface potential of the photosensitive member by the grid electrode; a current supply circuit connected to the charger and capable of supplying to the charger a first current not lower than a specified level for charging the surface of the photosensitive member at a first voltage at which an image of high contrast can be formed and a second current lower than the specified level for charging the surface of the photosensitive member at a second voltage at which an image having an intermediate gradation thereof emphasized is formed, the second voltage being lower than the first voltage; and a current switch circuit for switching the level of the current to be supplied to the charger means according to needs. Accordingly, a circuit construction of the charger can be simplified and the number of components thereof can be reduced, with the result that the price of the apparatus itself can be reduced.

4 Claims, 8 Drawing Sheets

IMAGE FORMING APPARATUS CAPABLE OF CHANGING THE SURFACE POTENTIAL OF A PHOTOSENSITIVE MEMBER

BACKGROUND OF THE INVENTION AND RELATED ART STATEMENT

This invention relates to an image forming apparatus such as a copying machine capable of changing the surface potential of a photosensitive member which is charged uniformly and stably with the use of a scorotron charger.

Conventionally, in a copying machine or like image forming apparatus, a document image scanned by an optical system is introduced to a photosensitive member, to thereby form an electrostatic latent image on the charged surface of the photosensitive member.

In recent years, there has been available an image forming apparatus having a picture mode for forming an image of a picture document in addition to a character mode for forming an image of a normal black-and-white document containing character information.

When the picture mode is set, the surface potential of the photosensitive member is set low in order to emphasize the intermediate gradation compared to a case where the normal black-and-white document is exposed. Accordingly, the image forming apparatus is required to have such a construction as to make the surface potential of the photosensitive member lower in the picture mode than that of the photosensitive member in the character mode.

An existing scorotron charger for charging the surface of the photosensitive member to attain a fixed surface potential will be described with reference to FIG. 8A. A wire 62 formed of tungsten or the like, when a high voltage is applied thereto from a high voltage supply 60, generates a corona discharge toward a photosensitive member 63 to which an opening of a screening electrode 61 formed of aluminum or the like is facing. A zener diode ZD10 is connected between a grid electrode 64 provided between the wire 62 and the photosensitive member 63 and a ground. The surface potential of the photosensitive member is regulated by the grid electrode 64 whose potential is maintained at a zener voltage, thus controlling the photosensitive member 63 to attain a desired surface potential uniformly and stably.

On the other hand, in another existing scorotron charger capable of causing the photosensitive member 63 to have a plurality of levels of surface potential, zener diodes ZD11, ZD12, and ZD13 are switchably connected between a grid electrode 64 and a ground as shown in FIG. 8B. Accordingly, the potential of the grid electrode 64 can be changed according to the level of the zener voltages by switching the connection, and therefore the photosensitive member 63 is controllably charged uniformly and stably so as to attain the desired level of surface potential.

In this way, the image forming apparatus including the picture mode is required to control the potential of the grid electrode at a multitude of states. Thus, such an image forming apparatus has suffered the disadvantages that a circuit construction for the charger becomes complicated, resulting in an increase in the number of components and in the price of the apparatus itself.

SUMMARY OF THE INVENTION

In view of the problems existing in the prior art, it is an object of the invention to provide an image forming apparatus capable of selectively setting a character mode and a picture mode in a suitable manner and of forming an image stably.

Accordingly, an image forming apparatus of the invention comprises a photosensitive member; charger means including a corona ion generator and a grid electrode provided between the photosensitive member and the corona ion generator and adapted for charging the surface of the photosensitive member while regulating the surface potential of the photosensitive member by the grid electrode; current supply means connected to the charger means and capable of supplying to the charger means a first current not lower than a specified level for charging the surface of the photosensitive member at a first voltage at which an image of high contrast can be formed and a second current lower than the specified level for charging the surface of the photosensitive member at a second voltage at which an image having an intermediate gradation thereof emphasized is formed, the second voltage being lower than the first voltage; and current switch means for switching the level of the current to be supplied to the charger means whenever necessary.

With the image forming apparatus thus constructed, in forming an image of a character document containing character information, the first current is supplied to the charger means, which in turn charges the surface of the photosensitive member uniformly at the first potential. As a result, there can be obtained the image of high contrast. On the other hand, in forming an image of a picture document, the second current is supplied to the charger means, and thereby the surface potential of the photosensitive member is reduced to the second potential. As a result, there can be obtained the image whose intermediate gradation is emphasized.

The current supply means may advantageously include a power supply, low voltage generator means having a first voltage generator connectable to the power supply and adapted for generating a voltage in accordance with the power supply and a second voltage generator for generating a voltage lower than the one generated in the first voltage generator, and high voltage generator means connected to the charger means and having a transformer for boosting the voltage generated in the low voltage generator means. The current switch means may advantageously include switch means for switchably connecting the first or second generator to the power supply.

With this arrangement, when the first voltage generator is connected to the power supply, the first current is supplied to the charger means from the high voltage generator means. On the other hand, when the second voltage generator is connected to the power supply, the second current is supplied to the charger means from the high voltage generator means.

The current switch means may further include designation means for instructing the switch means to switch the connection.

With this arrangement, the designation means instructs the switch means to connect the first voltage generator with the power supply in forming the image of the character document, while instructing the same to connect the second voltage generator with the power supply in forming the image of the picture document.

These and other objects, features and advantages of the present invention will become more apparent upon a reading of the following detailed description and accompanying drawings.

DETAILED DESCRIPTION OF PREFERRED EMBODIMENTS OF THE INVENTION

Figure 1:
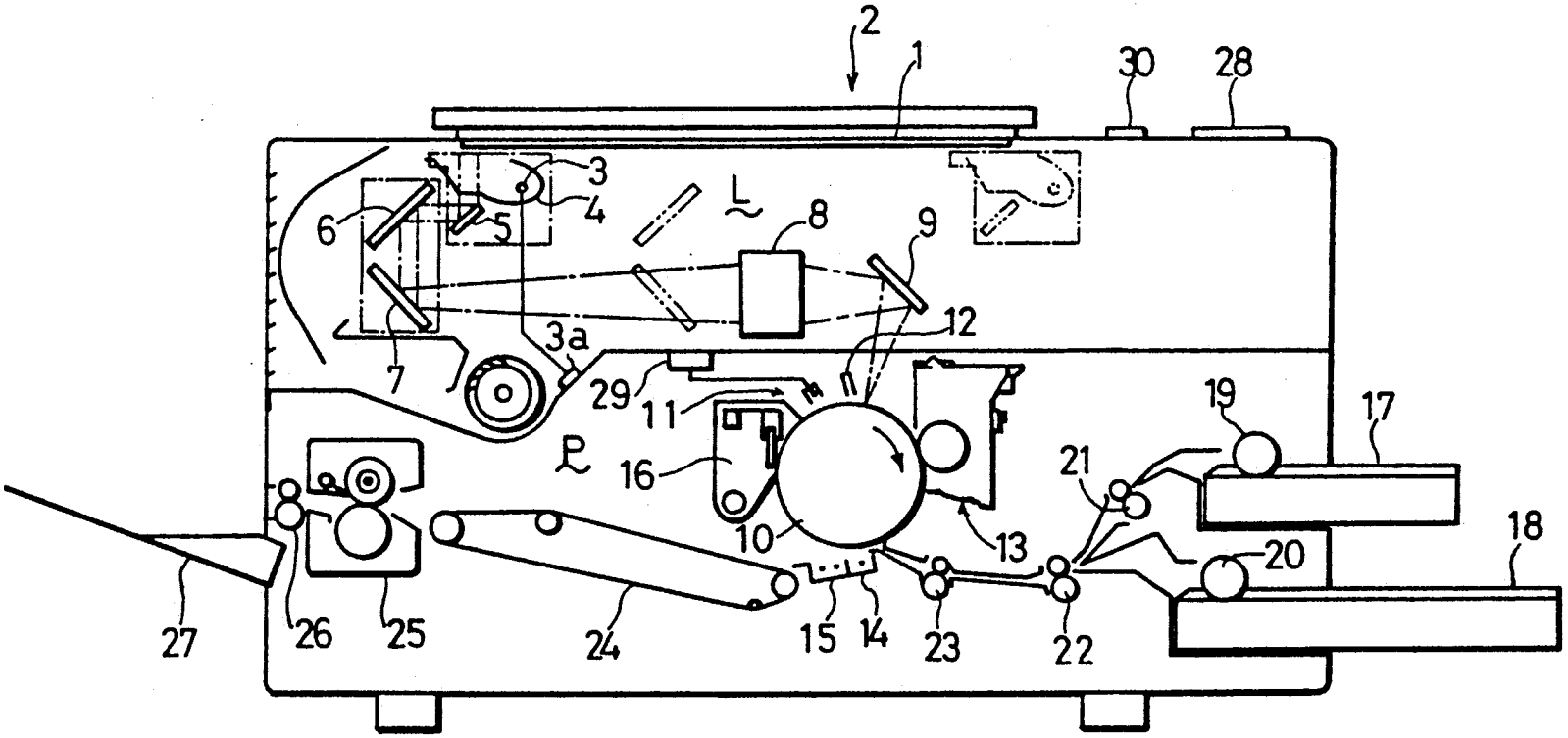
FIG. 1 is a schematic construction diagram showing an image forming apparatus embodying the invention.

A schematic construction of an image forming apparatus according to the invention will be described with reference to FIG. 1.

This image forming apparatus is provided with a transparent document platen 1 and a document holder 2 at the top thereof, and is internally provided with an optical system L, an imaging assembly P, a transport assembly for transporting copy sheets, and other components.

The optical system L is provided with a light source unit, reflecting mirrors 5, 6, 7, a lens unit 8, and a fixed mirror 9. The light source unit includes an exposure lamp 3 and a reflector 4, and moves reciprocally so as to scan a document image. The reflecting mirrors 5 to 7 reflect the light reflected by the document face to thereby form an optical path. The lens unit 8 adjusts the magnification of an image to be formed, or the like. The fixed mirror 9 reflects the reflected light so as to direct the same to a photosensitive member 10.

The imaging assembly P is provided with the photosensitive member 10 in the form of a drum, a scorotron charger 11, a high voltage supply 29, a blank lamp 12, a developing device 13, a transfer charger 14, a separating charger 15, a cleaning device 16, etc. The photosensitive member 10 has an electrostatic latent image formed on the surface thereof. The scorotron charger 11 charges the photosensitive member 10 so as to attain a desired surface potential. The high voltage supply 29 supplies a current at a high voltage to the scorotron charger 11. The blank lamp 12 removes electric charges on an unnecessary portion of the surface of the photosensitive member 10. The developing device 13 causes the toner to be charged and attracted to the electrostatic latent image so as to develop the same into a toner image. The transfer charger 14 transfers the toner image onto a sheet, and the separating charger 15 separates the image bearing sheet from the surface of the photosensitive member 10. The cleaning device 16 cleans the toner residual on the surface of the photosensitive member 10 after the image transfer operation.

The transport assembly includes cassettes 17, 18 for containing different sized sheets therein, feed rollers 19, 20 for feeding the sheets, pairs of transport rollers 21, 22, and a pair of registration rollers 23 arranged in this order from an upstream side with respect to a transport direction of the sheet. Further, downstream of the photosensitive member 10, there are arranged a transport belt 24 for transporting the sheet, a fixing device 25 for fixing the toner image onto the sheet, a pair of discharge rollers 26 for discharging the sheet onto a discharge tray 27, and the like.

At specified positions of the upper surface of the image forming apparatus are provided an operation panel 28 and a mode setting portion 30. With the use of the operation panel 28, an operator is allowed to set the size of the document and the copy sheet, a magnification mode, a reduction mode, etc. Further, with the use of the mode setting portion 30, the operator is allowed to set a "character mode" for normal black-and-white documents containing character information or the like and a "picture mode" for picture documents or the like.

Figure 2:
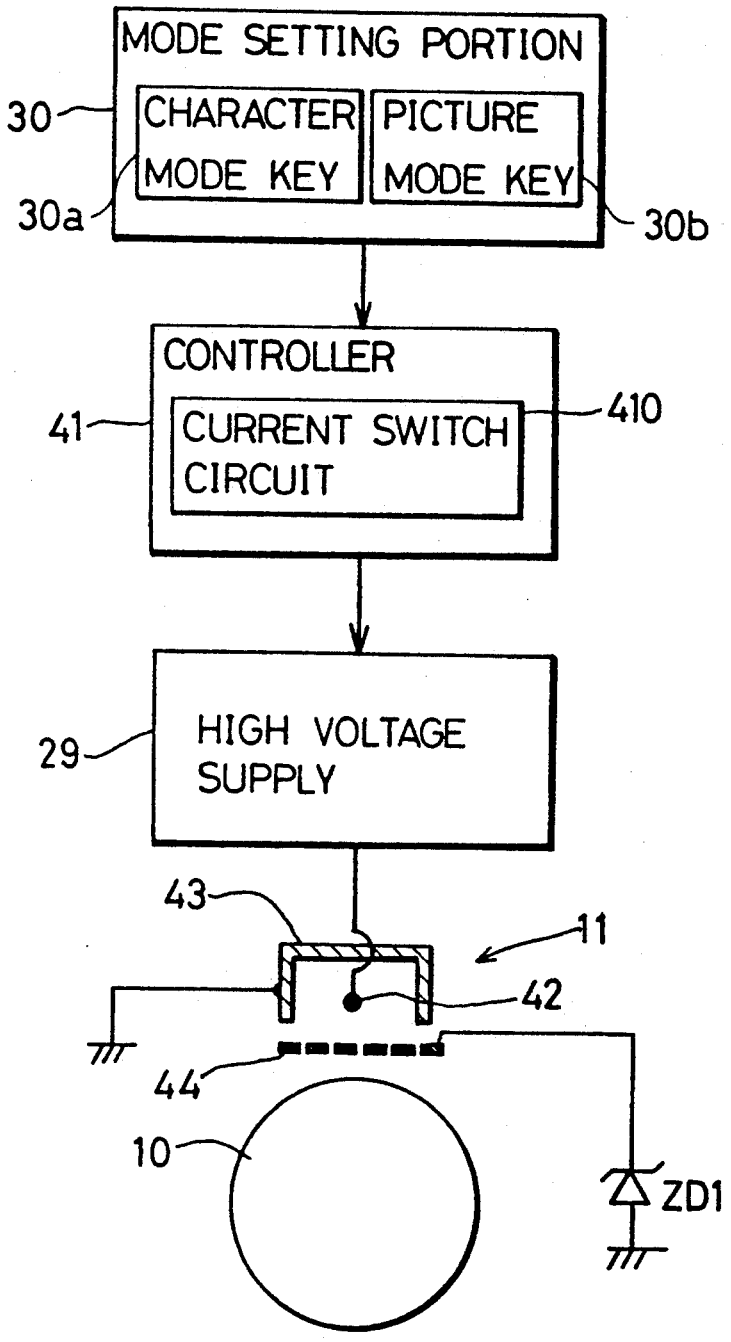
FIG. 2 is a block diagram showing a construction of a control system of the image forming apparatus.

A control system of the image forming apparatus according to the invention will be described next with reference to FIG. 2.

The mode setting portion 30 includes a character mode key 30*a* which is manipulated to set the character mode, and a picture mode key 30*b* which is manipulated to set the picture mode.

A thin wire 42 is formed of, for example, tungsten and generates the corona discharge upon application of a high voltage thereto from the high voltage supply 29 including a transformer or the like, thereby charging the surface of the photosensitive member 10 by thus generated corona ions. A screening electrode 43 is formed of, for example, aluminum and is adapted for shielding the corona discharge. The electrode 43 has an opening facing the photosensitive member 10 so that the corona ions are released toward the photosensitive member 10. A grid electrode 44 is formed of several wires or meshes insulated from the screening electrode 43, and is provided between the wire 42 and the photosensitive member 10. A zener diode ZD1 is connected between the grid electrode 44 and a ground, and maintains the potential of the grid electrode 44 at, for example, a zener voltage of 880 V. The surface potential of the photosensitive member 10 is regulated by the grid electrode 44 so as to be charged uniformly and stably at a desired potential.

A controller 41 includes a current switch circuit 410, a microcomputer, etc. and controls an overall operation of the image forming apparatus. The current switch circuit 410 switches the level of a current to be supplied form the high voltage supply 29 to the wire 42 according to the mode set through the mode setting portion 42.

Figure 3:
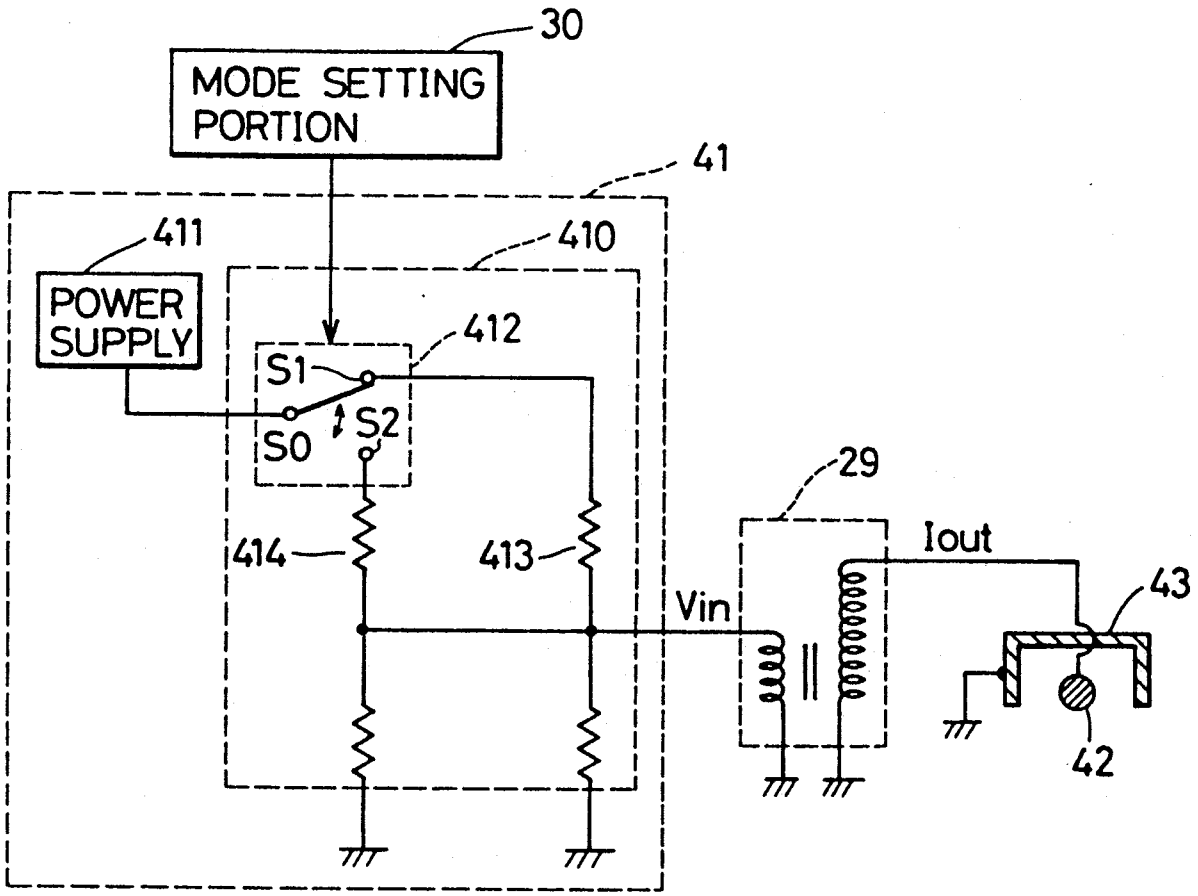
FIG. 3 is a circuit diagram showing an exemplary current switch circuit.
Figure 4:
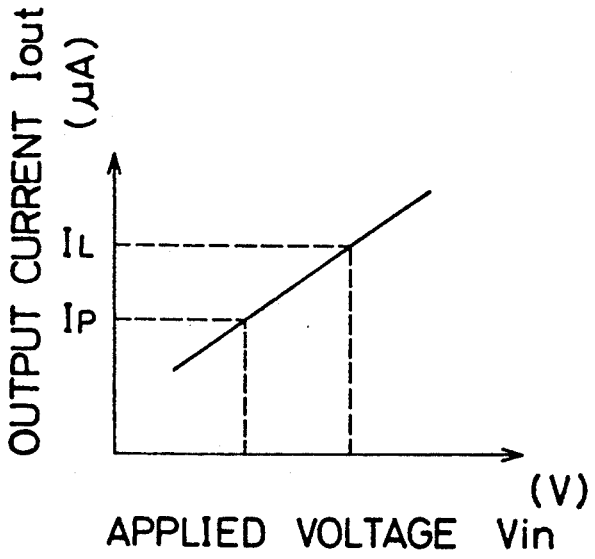
FIG. 4 is a graphical representation showing a characteristic of an output current as a function of an input voltage to a high voltage supply.

An exemplary current switch circuit 410 will be described with reference to FIGS. 3 and 4.

A switch unit 412 includes a contact S0 connected to a power supply 411 provided in the controller 41 and contacts S1, S2 connected respectively to tapped resistor circuits 413, 414. The contact to be connected with the contact S0 is switched between the contacts S1 and S2 according to the mode set through the mode setting portion 30 which functions as a switch designation means for instructing switch unit 412. The tapped resistor circuits 413, 414 divide a voltage applied from the power supply 411 and apply to the high voltage supply 29 voltages Vin suitable for the character mode and the picture mode respectively.

Normally, the contact S0 is connected with the contact S1. When the character mode is changed to the picture mode, the contact S0 is connected with the contact S2, thereby reducing the voltage Vin applied to the high voltage supply 29. In this way, the out current Iout supplied to the wire 42 is reduced as shown in FIG. 4.

There will be described a characteristic of the surface potential of the photosensitive member 10 as related to the output current supplied from the high voltage supply 29 to the wire 42 with reference to FIG. 5.

Figure 5:
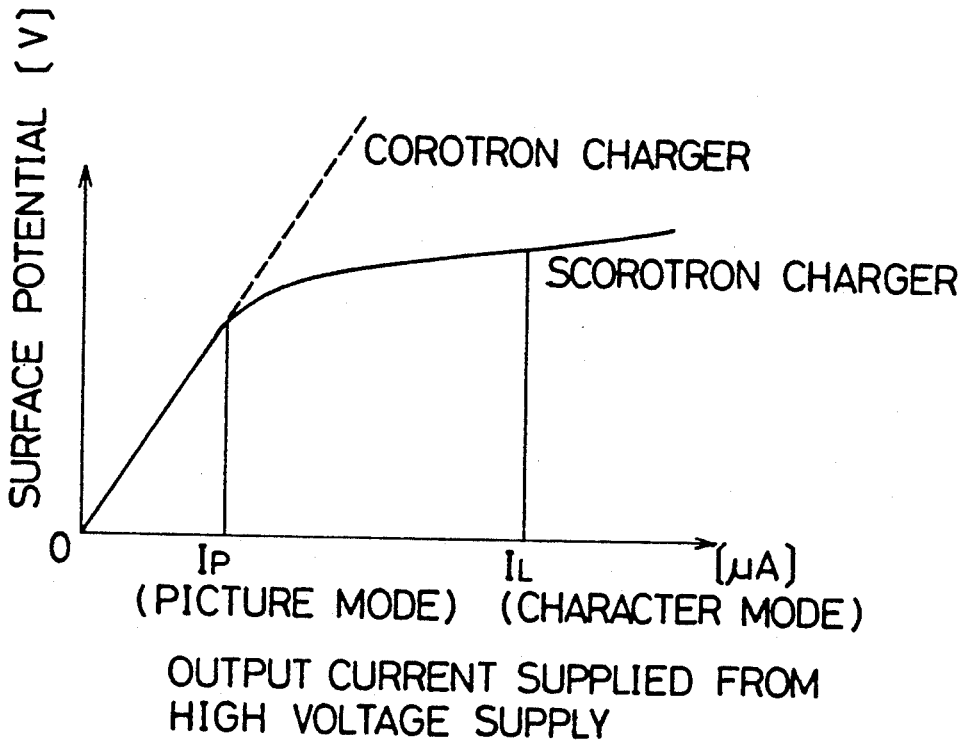
FIG. 5 is a graphical representation showing a change of a surface potential of a photosensitive member when the output current of the high voltage supply is changed.

As shown in FIG. 5, the surface potential of the photosensitive member 10 is saturated where the output current is high. This is because the surface potential is regulated by the zener voltage of the zener diode ZD1 connected to the grid electrode 44.

On the other hand, when the output current decreases, the characteristic of the surface potential approximates to a characteristic of a scorotron charger not including a grid electrode, and the surface potential decreases.

In view of the above characteristic, it is found appropriate to set the output current at a current value IL at which the surface potential is saturated when the character mode is set, and to set the output current at a current value IP (<IL) below which the surface potential decreases when the picture mode is set.

Next, there will be described results of an experiment conducted by the inventors of the present invention with reference to TABLE-1 and FIG. 6.

TABLE 1

| CURRENT (μ) | SURFACE POTENTIAL (V) | CHARGING STABILITY | INTERMEDIATE GRADATION REPRODUCIBILITY |
|---|---|---|---|
| 100 | 250 | POOR | VERY GOOD |
| 200 | 600 | POOR | VERY GOOD |
| 300 | 700 | NORMAL | GOOD |
| 400 | 750 | GOOD | GOOD |
| 500 | 775 | GOOD | NORMAL |
| 600 | 800 | VERY GOOD | NORMAL |
| 700 | 825 | VERY GOOD | POOR |
| 800 | 850 | VERY GOOD | POOR |

TABLE-1 shows the surface potential of the photosensitive member 10, the charging stability, and the reproducibility of the intermediate gradation when the output current supplied from the high voltage supply 29 to the wire 42 is changed. As seen from this table, as the output current increases, the surface potential increases and the charging stability is improved while the reproducibility of the intermediate gradation is deteriorated.

Generally, the character mode requires the high contrast and the satisfactory level of the charging stability of the photosensitive member 10. On the other hand, the picture mode requires a specified level of the charging stability of the photosensitive member 10 as well as the low contrast and the satisfactory level of the reproducibility of the intermediate tone.

Figure 6:
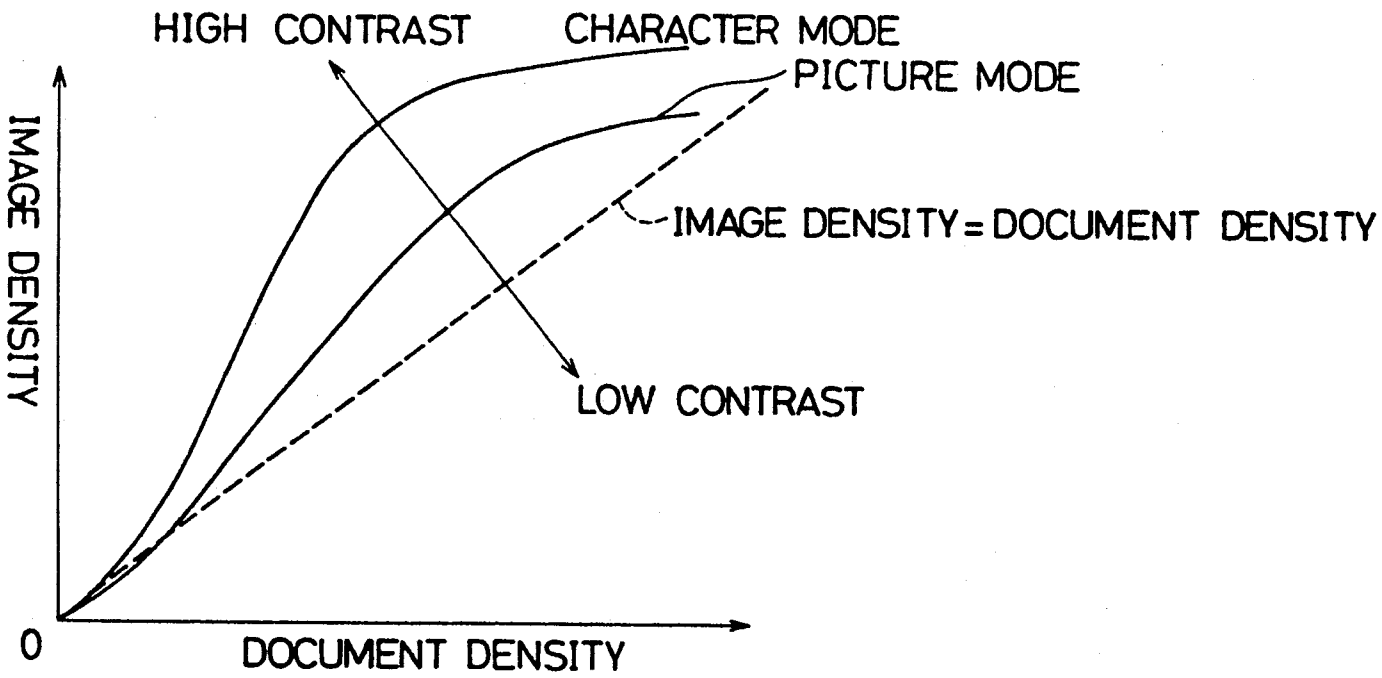
FIG. 6 is a graphical representation showing the reproducibility of an image density as related to a document density.

FIG. 6 is a graphical representation showing the reproducibility of the image density as related to the document density. The output current was set at 600 μA in the character mode while being set at 400 μ in the picture mode. As shown in this graph, the high contrast was obtained in the character mode. Further, in the picture mode was obtained the satisfactory reproducibility of the intermediate gradation which was located close to a line representing (image density=document density) indicated by a broken line in FIG. 6.

Figure 7:
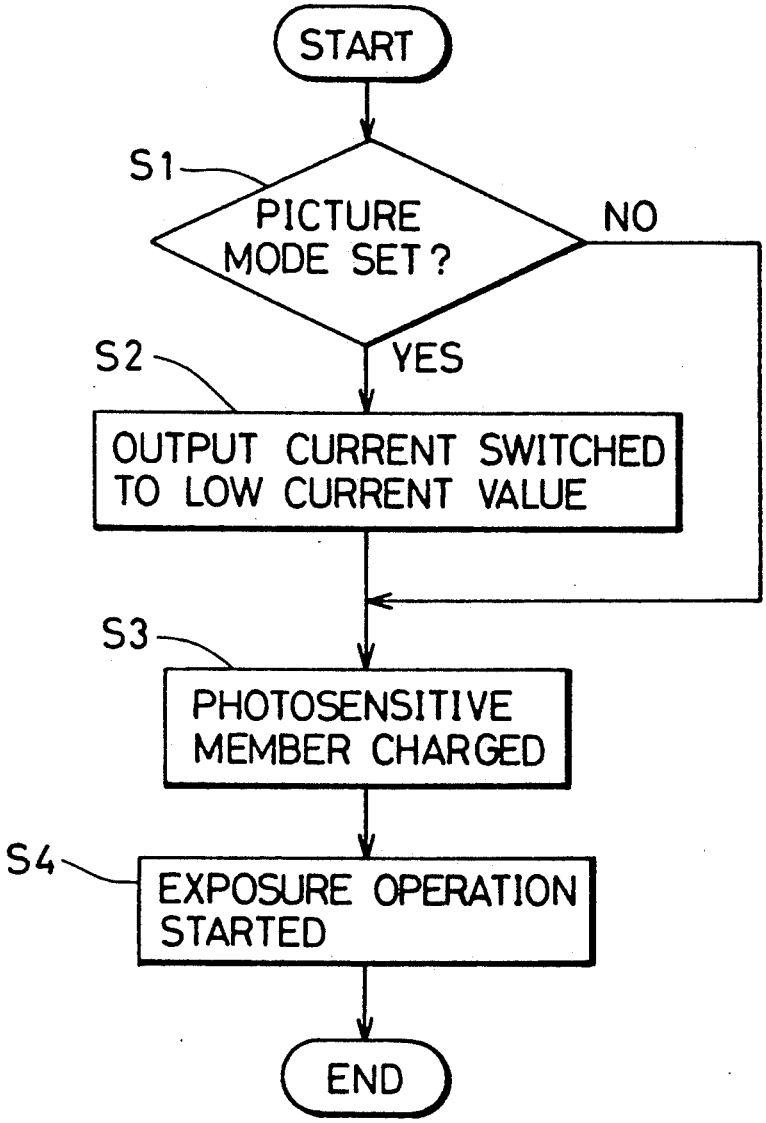
FIG. 7 is a flow chart showing an operation procedure of the image forming apparatus.
Figure 8A:
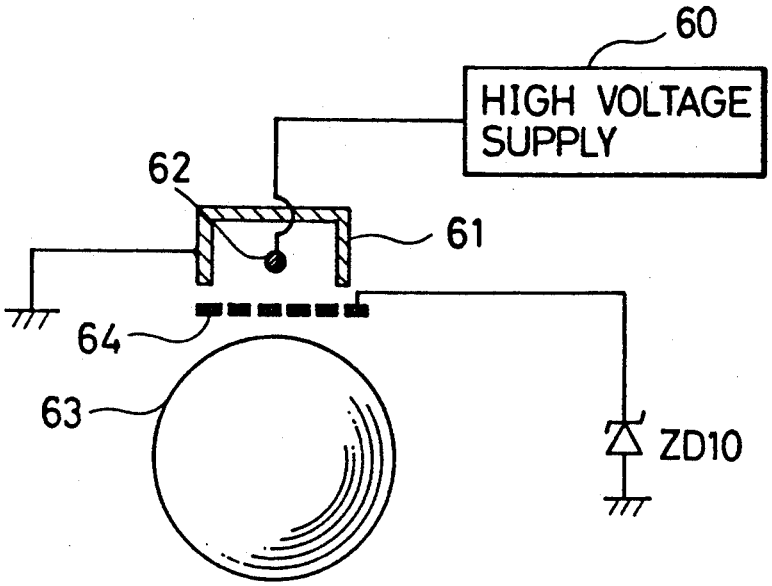
FIG. 8A PRIOR ART
FIG. 8A is a schematic construction diagram showing an existing scorotron charger with which the surface potential of the photosensitive member is fixed at a specified value.
Figure 8B:
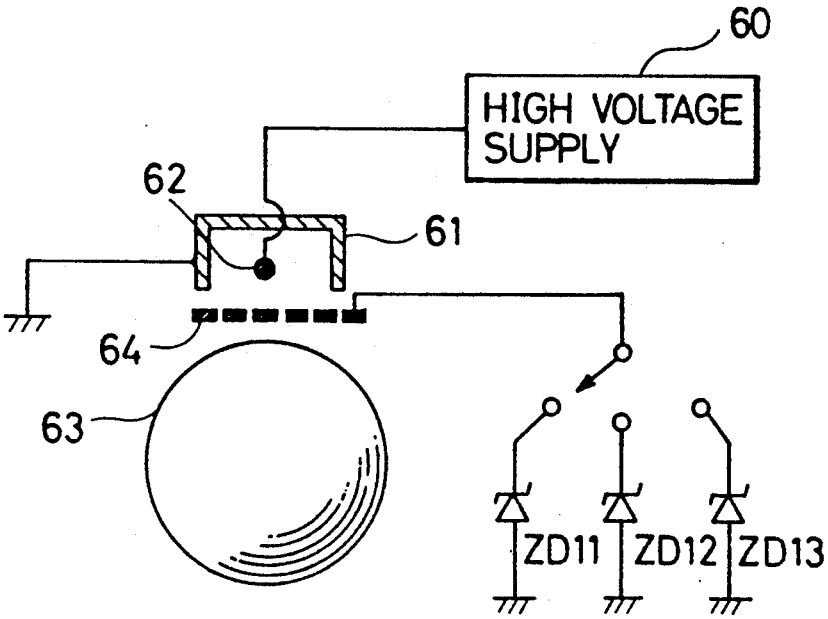
FIG. 8B PRIOR ART
FIG. 8B is a schematic construction diagram showing another existing scorotron charger with which the surface potential of the photosensitive member can be set switchably among a plurality of levels.

There will be described an operation procedure of the image forming apparatus next with reference to a flow chart shown in FIG. 7.

When the operation of the image forming apparatus is started, it is discriminated whether the mode set through the mode setting portion 30 is the picture mode in Step S1. If the picture mode is set (YES in Step S1), the output current of the high voltage supply 29 is switched to the low current value IP (see FIG. 5) by the current switch circuit 410 in Step S2. On the other hand, if the character mode is set (NO in Step S1), this routine proceeds to Step S3 while maintaining the output current at the original current value IL (see FIG. 5). Subsequently, the photosensitive member 10 is charged in Step S3 and an exposure operation is started in Step S4. More specifically, the light from the light source unit is reflected by the face of the document placed on the transparent document platen 1. The reflected light is introduced to the lens unit 8 through the reflecting mirrors 5 to 7, and is projected through the fixed mirror 9 to a transfer region defined on the surface of the photosensitive member 10, thereby forming an electrostatic latent image thereon.

Subsequently, the charged toner supplied from the developing device 13 to the photosensitive member 10 is attracted to the electrostatic latent image, thereby developing the same into a toner image. The toner image is transferred by the transfer charger 14 to the sheet, which is then separated from the surface of the photosensitive member 10 by the separating charger 15. After having the transferred toner image fixed thereon by the fixing device 25, the sheet is discharged onto the discharge tray 27 by the discharge roller pair 26.

In this way, the output current of the high voltage supply 29 is switched to the low current value IP when the picture mode is set, thereby reducing the surface potential of the photosensitive member 10 to the value suited to form the image of the picture document.

With the above arrangement, the surface of the photosensitive member 10 can be charged uniformly and stably using the scorotron charger having a simple circuit construction, and the price of the image forming apparatus can be reduced by reducing the number of its components.

Although a zener diode is used in the foregoing embodiment, any device such as a varistor can be also used provided that it is capable of supplying a constant voltage.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus comprising:

a photosensitive member;

charger means for charging the surface of the photosensitive member while regulating the surface potential of the photosensitive member, said charger means including:

corona ion generator means for charging the surface of the photosensitive member, and grid electrode means provided between the photosensitive member and the corona ion generator means for regulating the surface potential of the photosensitive member;

current supply means connected to the corona ion generator means for supplying to the corona ion generator means:

a first current not lower than a specified level for charging the surface of the photosensitive member at a first stabilized voltage at which an image of high contrast can be formed, and a second current lower than the specified level for charging the surface of the photosensitive member at a second stabilized voltage at which an image having an intermediate gradation thereof can be formed, the second stabilized voltage being lower than the first stabilized voltage; and current switch means for switching the level of the current to be supplied by said current supply means to the corona ion generator means between said first current when an image of high contrast is to be formed, and said second current when an image having an intermediate gradation thereof is to be formed.

2. An image forming apparatus as defined in claim 1 wherein:

the current supply means includes:

a power supply, low voltage generator means having:

first voltage generator means connectable to the power supply for generating a voltage in accordance with the power supply, and second voltage generator means for generating a voltage lower than the voltage generated in the first voltage generator means, and high voltage generator means connected to the charger means and having transformer means for boosting the voltage generated in the low voltage generator means; and the current switch means includes switch means for switchably connecting the first or second voltage generator means to the power supply.

3. An image forming apparatus as defined in claim 2 wherein the current switch means further includes designation means for instructing the switch means to switch the connection of the first or second voltage generator means to the power supply.

4. An image forming apparatus comprising:

a photosensitive member;

charger means for charging the surface of the photosensitive member while regulating the surface potential of the photosensitive member, said charger means including:

corona ion generator means for charging the surface of the photosensitive member, and grid electrode means provided between the photosensitive member and the corona ion generator means for regulating the surface potential of the photosensitive member;

current supply means connected to the charger means for supplying to the charger means:

a first current not lower than a specified level for charging the surface of the photosensitive member at a first stabilized voltage at which an image of high contrast can be formed, and a second current lower than the specified level for charging the surface of the photosensitive member at a second stabilized voltage at which an image having an intermediate gradation thereof can be formed, the second stabilized voltage being lower than the first stabilized voltage; and current switch means for switching the level of the current to be supplied by said current supply means to the charger means between said first current when an image of high contrast is to be formed, and said second current when an image having an intermediate gradation thereof is to be formed.

* * * * *